US006434806B1

(12) United States Patent
Walt, II

(10) Patent No.: US 6,434,806 B1
(45) Date of Patent: Aug. 20, 2002

(54) MACHINE FOR INSTALLING FLEXIBLE COVERS ON SEAT CUSHIONS HAVING SLIDING STANCHION CARRIAGE FOR CLOSELY FOLLOWING THE CONTOUR OF THE SEAT CUSHION

(75) Inventor: Michael Allen Walt, II, DeKalb, IL (US)

(73) Assignee: LMS Walt, Inc., DeKalb, IL (US)

( * ) Notice: Subject to any disclaimer, the term of this patent is extended or adjusted under 35 U.S.C. 154(b) by 111 days.

(21) Appl. No.: 09/602,957

(22) Filed: Jun. 23, 2000

Related U.S. Application Data

(63) Continuation-in-part of application No. 09/356,925, filed on Jul. 19, 1999, now Pat. No. 6,298,532.

(51) Int. Cl.[7] ..... B08G 7/00; B08G 15/00

(52) U.S. Cl. ..... 29/91.5; 29/91; 29/91.8

(58) Field of Search ..... 29/91.5, 91, 235, 29/713, 91.7, 91.8, 281.1, 281.4

(56) References Cited

U.S. PATENT DOCUMENTS

| | | | | |
|---|---|---|---|---|
| 3,438,108 A | | 4/1969 | Nash | 29/91.5 |
| 4,385,427 A | | 5/1983 | Fraiser | 29/91.5 |
| 4,675,962 A | | 6/1987 | Tillner et al. | 29/91.1 |
| 4,874,448 A | * | 10/1989 | Urai | 156/196 |
| 5,287,610 A | | 2/1994 | Gomolak et al. | 29/91.1 |
| 5,398,393 A | | 3/1995 | Bentschneider | 29/91.5 |
| 5,457,864 A | * | 10/1995 | Sakaida | 29/91.5 |
| 5,603,150 A | * | 2/1997 | Assink et al. | 29/91.8 |
| 5,774,965 A | | 7/1998 | Mintz et al. | 29/91.5 |
| 6,000,292 A | | 12/1999 | Nagai et al. | 74/89.15 |

* cited by examiner

*Primary Examiner*—David P. Bryant
*Assistant Examiner*—John C. Hong
(74) *Attorney, Agent, or Firm*—Leydig, Voit & Mayer, Ltd.

(57) ABSTRACT

A seat assembly machine that uses stanchion rods to install flexible covers on seat cushions characterized by the fact that the stanchion rods are slidably mounted via slides in an axis generally perpendicular to the stuffing or plunging axis such that the stanchion rods more closely follow the contour of the seat cushion. The present invention can be applied to either bottom seat cushion stuffers, back rest stuffers or neck cushion stuffers as desired. In the preferred embodiment the combination of a cam mechanism and spring mechanism controls sliding movement of the stanchion rods. The cam mechanism includes a cam track having an eccentric substantially matched closely to the contour of the intended seat cushion and a follower adapted to follow the eccentric.

21 Claims, 9 Drawing Sheets

MACHINE FOR INSTALLING FLEXIBLE COVERS ON SEAT CUSHIONS HAVING SLIDING STANCHION CARRIAGE FOR CLOSELY FOLLOWING THE CONTOUR OF THE SEAT CUSHION

RELATED APPLICATIONS

This application is a continuation-in-part of U.S. patent application, Ser. No. 09/356,925, filed Jul. 19, 1999, U.S. Pat. No. 6,298,532 the entire disclosure of which is hereby incorporated by reference.

FIELD OF THE INVENTION

The present invention relates to seat assembly apparatus and more particularly, to a seat cushion stuffer adapted to assemble covers on compressible foam seat cushions.

BACKGROUND OF THE INVENTION

Seats for the automotive industry include compressible foam seat cushions and flexible covers. Because the covers fit rather tightly on the seat cushion, machine assistance is used to assembly and tightly fit the cover on the seat cushion. There are a number of known machines for installing the flexible covers on foam cushions. For example, U.S. Pat. No. 5,398,393 is a bottom seat stuffer adapted to install flexible seat covers on bottom seat cushions. U.S. Pat. Nos. 5,774,965 and 4,385,427 disclose upper seat cushion (for the backrest) stuffers or skinners adapted to install flexible seat covers on upper seat cushions to provide for the backrest of a seat. There are also machines to install the flexible cover on the neck rest cushion as well.

Heretofore, each of these machines and other similar machines have not done a satisfactory job installing the seat covers on the foam cushions, as will be particularly appreciated by those skilled in the art when viewing the present invention. In particular, due in part to the contours and curvature of the seat cushions, it is often necessary for the worker to correct the alignment of the seat cover on the seat cushion after the machine has already performed the stuffing or skinning operation. This results in worker fatigue and therefore a less efficient worker as fewer seats per hour can be assembled. These machines have also been known to damage or rip the seat covers at an undesirable frequency.

SUMMARY OF THE INVENTION

It is the primary objective of the present invention to provide a machine that achieves a better fit of a seat cover on a foam seat cushion for automotive industry applications.

In that regard, it is another objective of the present invention to provide a highly reliable machine that is user friendly and minimizes worker fatigue.

In accordance with these and other objectives the present invention provides a seat assembly machine that uses stanchion rods to install flexible covers on seat cushions characterized by the fact that the stanchion rods are slidably mounted in an axis generally perpendicular to the stuffing or plunging axis such that the stanchion rods more closely follow the contour of the seat cushion. The present invention can be applied to either bottom seat cushion stuffers, back rest stuffers or neck cushion stuffers as desired. In the preferred embodiment a cam mechanism and/or a spring mechanism (either in combination or alone) controls sliding movement of the stanchion rods. The cam mechanism includes a cam track having an eccentric substantially matched closely to the contour of the intended seat cushion and a follower adapted to follow the eccentric. It is an advantage the seat covers can be more properly installed on the seat cushion.

Other object and advantages of the invention will become more apparent from the following detailed description when taken in conjunction with the accompanying drawings.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Figure 1:
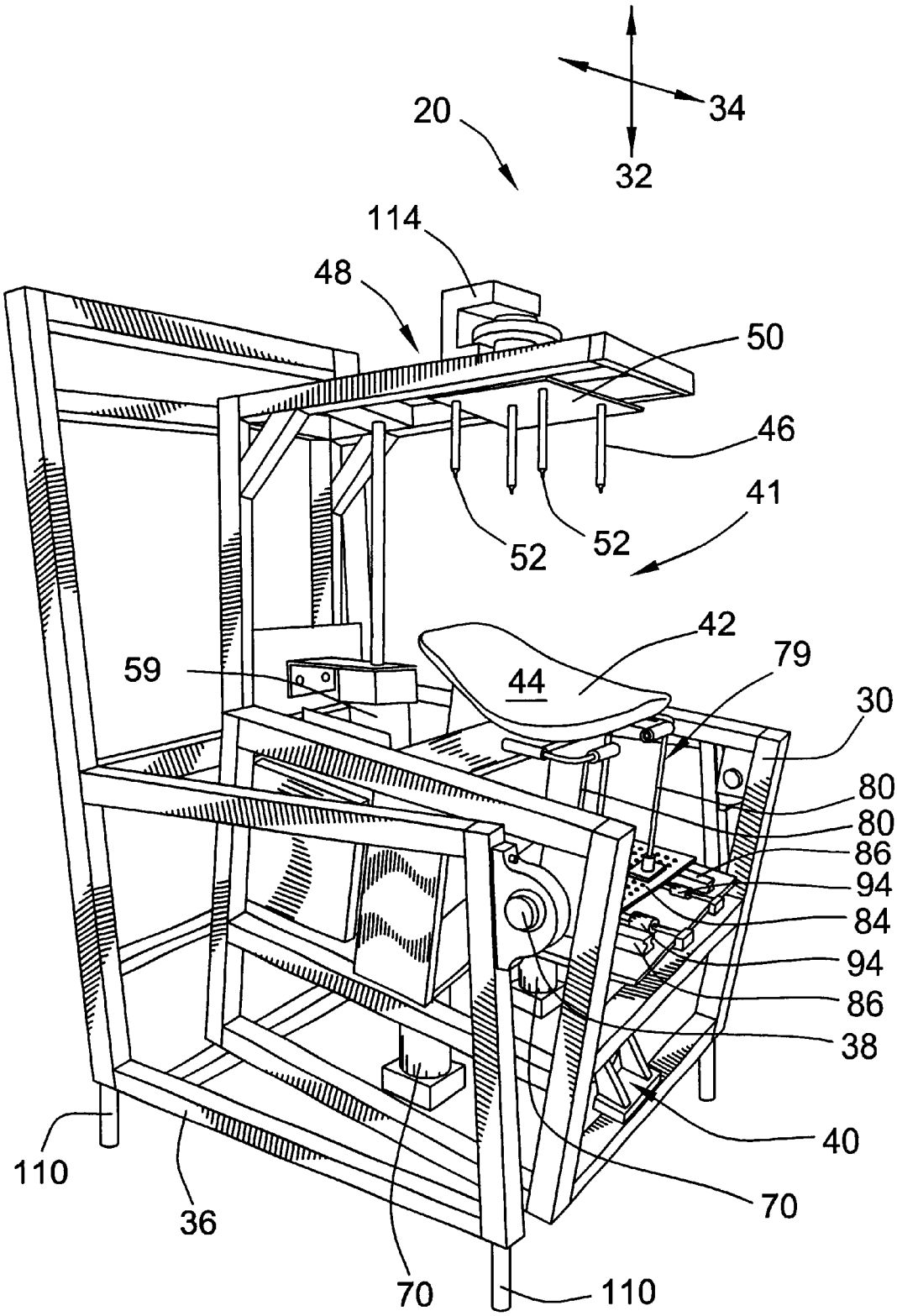
FIG. 1 is a perspective view of a seat assembly machine according to an embodiment the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

Referring to the figures, a preferred embodiment of the present invention has been illustrated in the form of a bottom seat stuffing machine 20 for installing a flexible seat cover 22 on a foam seat cushion 24. In the preferred embodiment, the foam seat cushion 24 is already partially assembled with a metal frame 26 and a foam pad 28.

Figure 2:
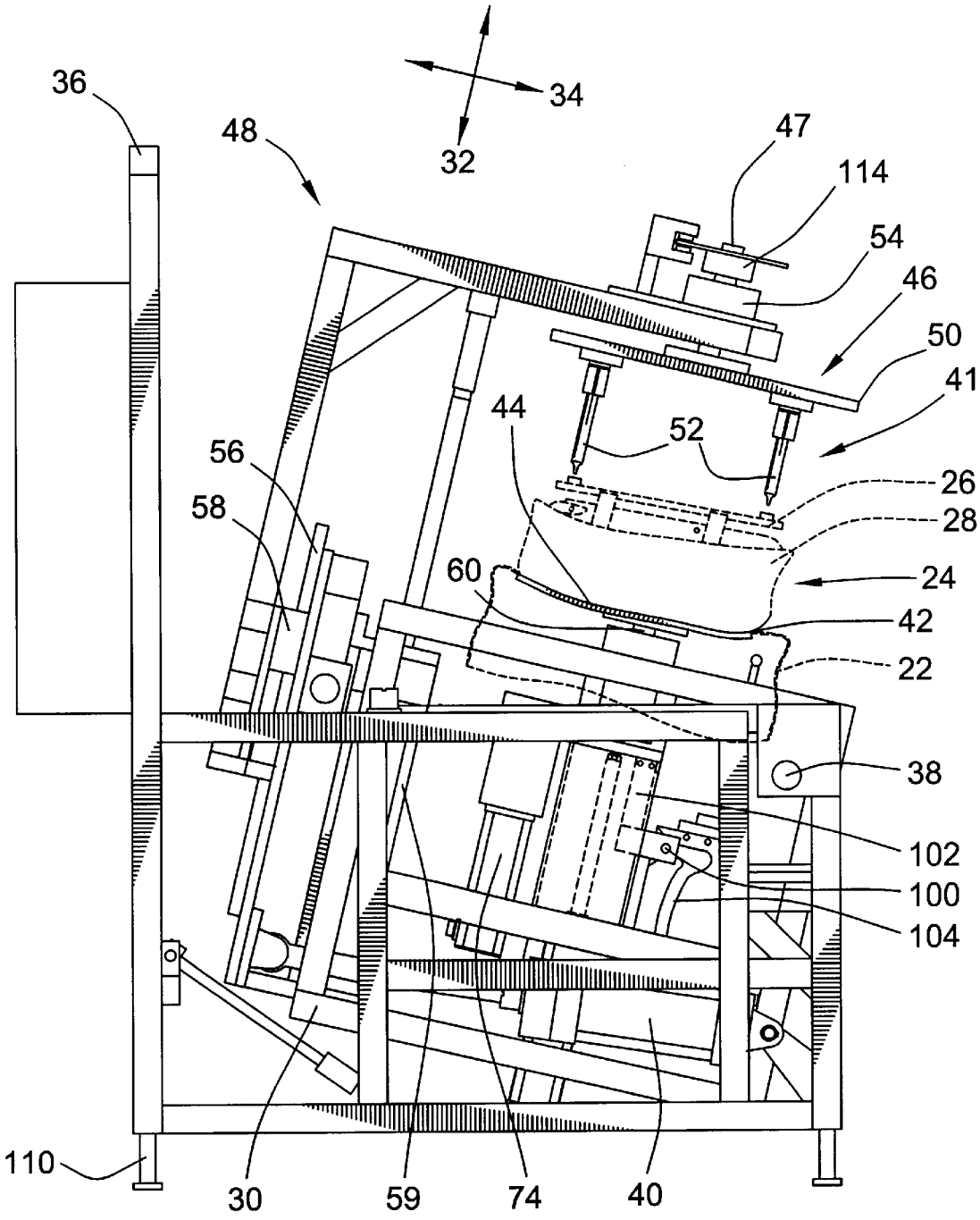
FIG. 2 is a side view of a seat assembly machine according to an embodiment of the present invention.
Figure 3:
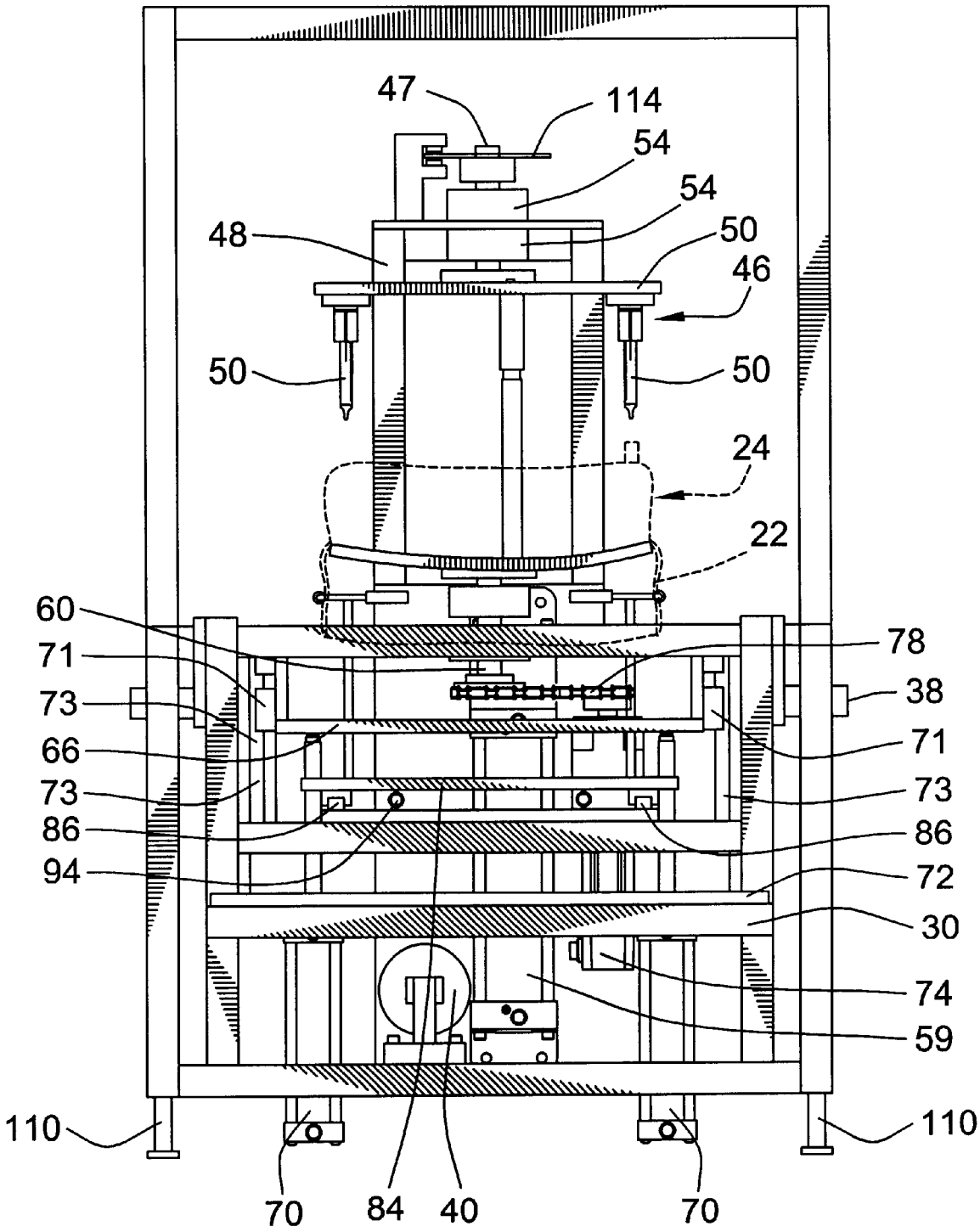
FIG. 3 is a front elevational view of the machine illustrated in FIG. 2.
Figure 4:
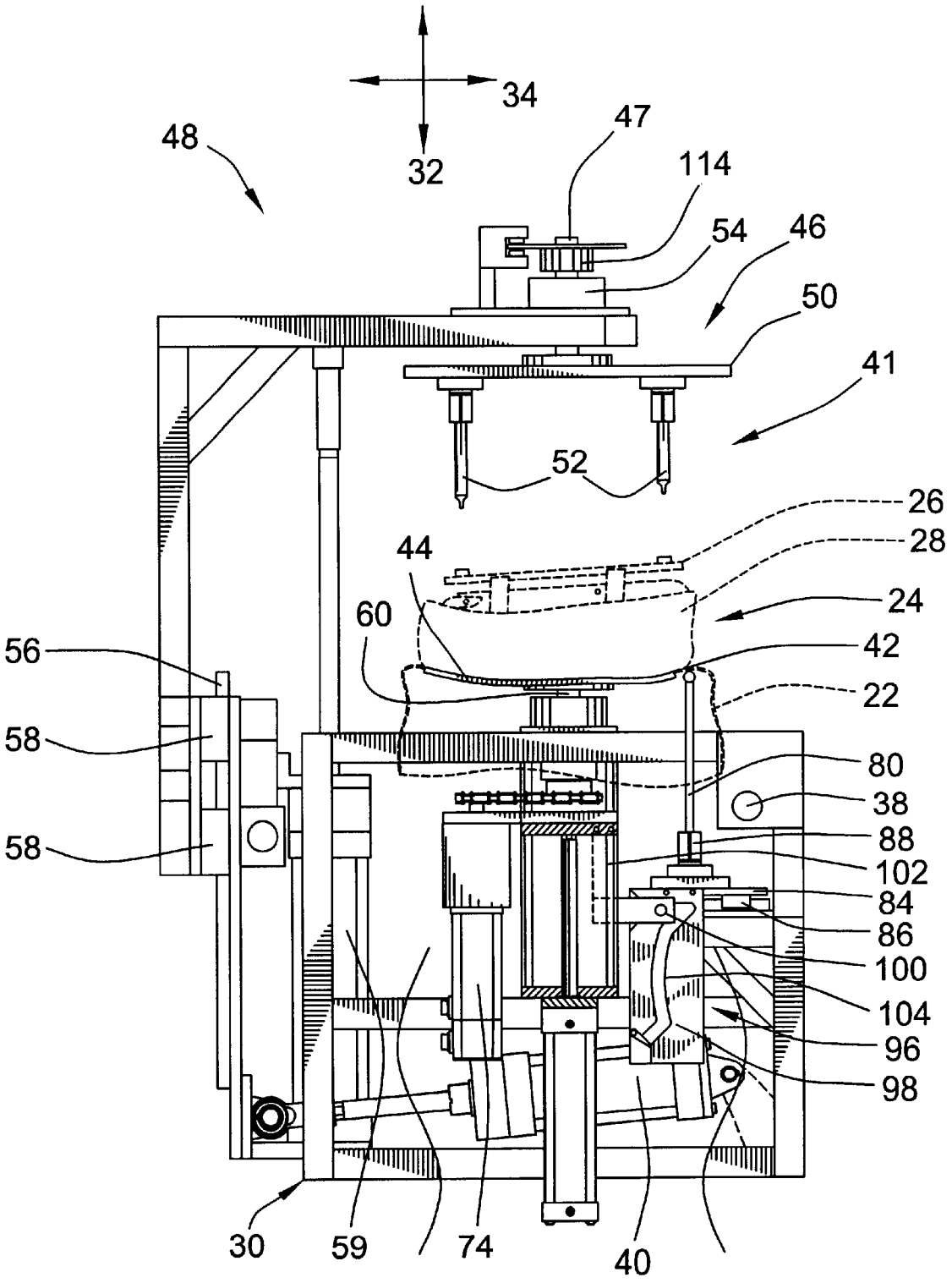
FIG. 4 its a side elevational view of the inner frame assembly of the machine illustrated in FIG. 2, with the outer support frame and removed.

The bottom seat stuffing machine 20 includes a support frame 30 having first and second mutually perpendicular axes 32, 34, which are generally vertical and horizontal, also designated as plunging axis 32 and stanchion sliding axis 34. The term "generally" is used to define horizontal because the machine 20 may include an optional tilt feature which tilts the frame slightly as shown in FIGS. 1–3 to make the machine more user friendly and easier for a worker to load and unload the seat cushions 24, and also because the axes 32 and 34 also do not have to be perfectly perpendicular but sufficiently perpendicular to allow the function of the stanchion rods more closely following the contour of the seat cushions. It will be appreciated to those skilled in the art that when a metal frame 26 (which is typically steel and very heavy) is pre-assembled with the foam pad 28, the seat cushion 24 is very heavy and the tilt feature is desirable in that it allows workers to more easily load and unload the seat cushions 24, thereby reducing worker fatigue and improving productivity levels.

Figure 5:
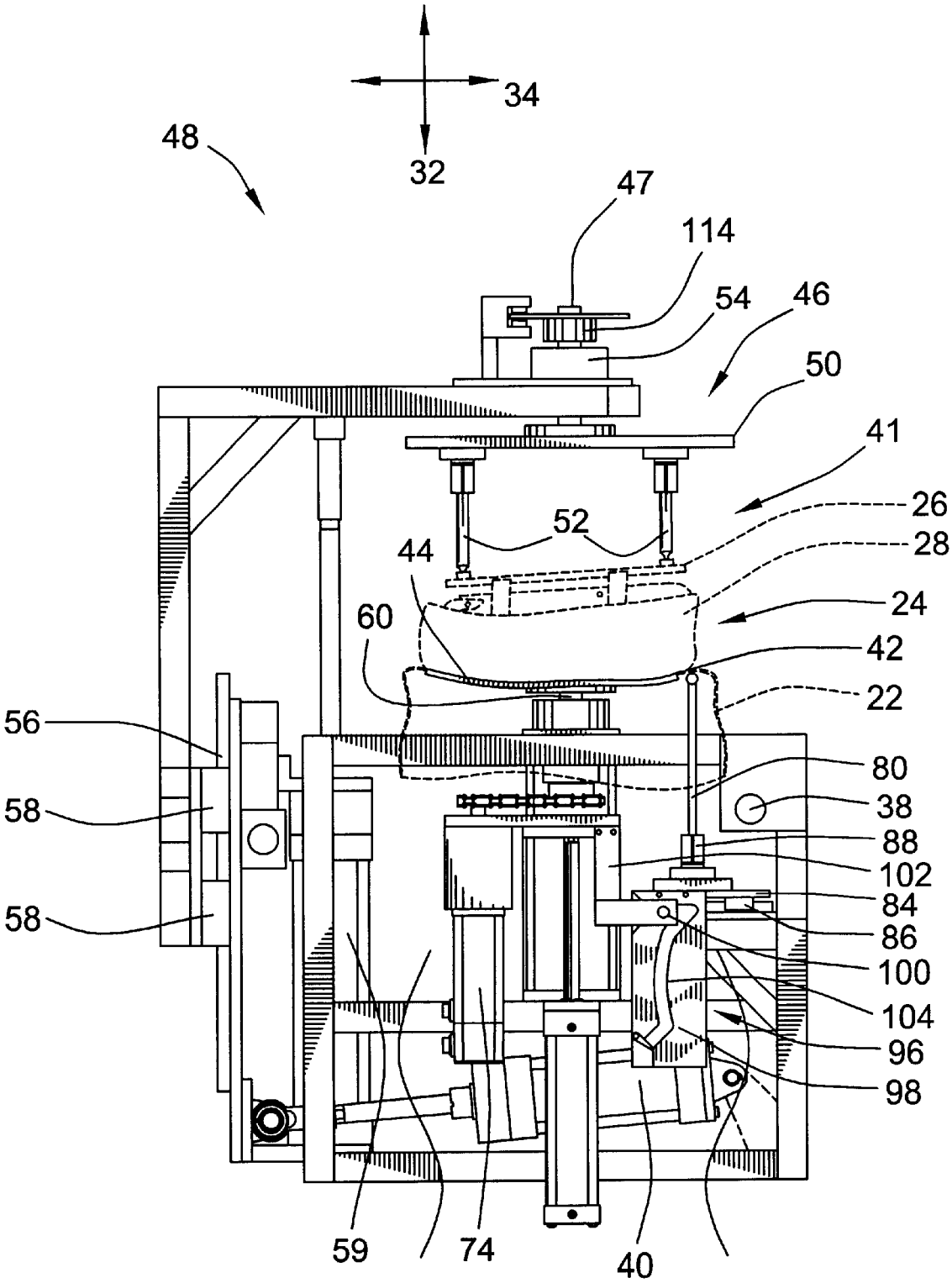
FIGS. 5–7 are the same views as FIG. 4 but illustrating the machine in the various different positions assembling a cover on a seat cushion and part of the machine being cut away to better see the plunging movement of the machine.
Figure 6:
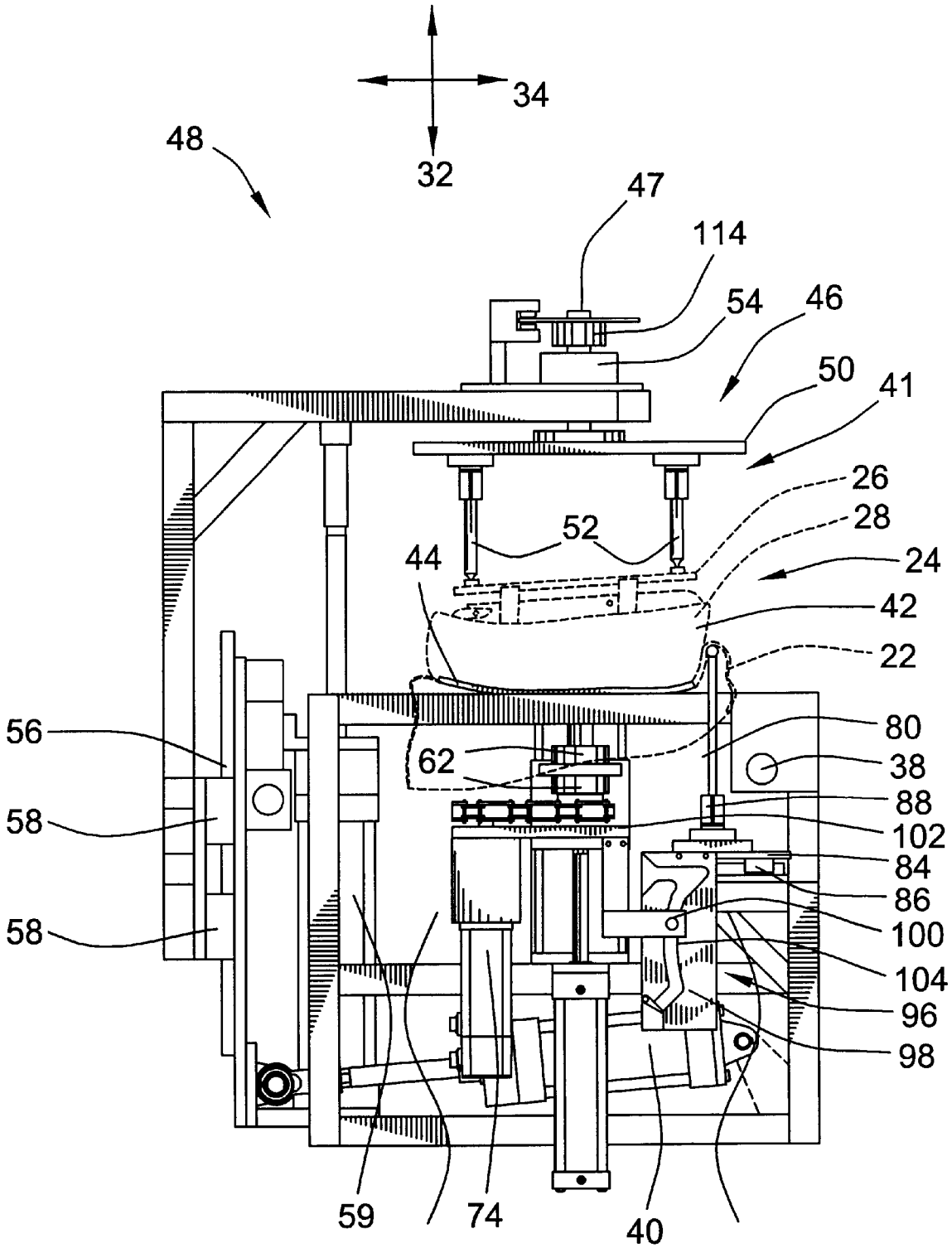
Figure 7:
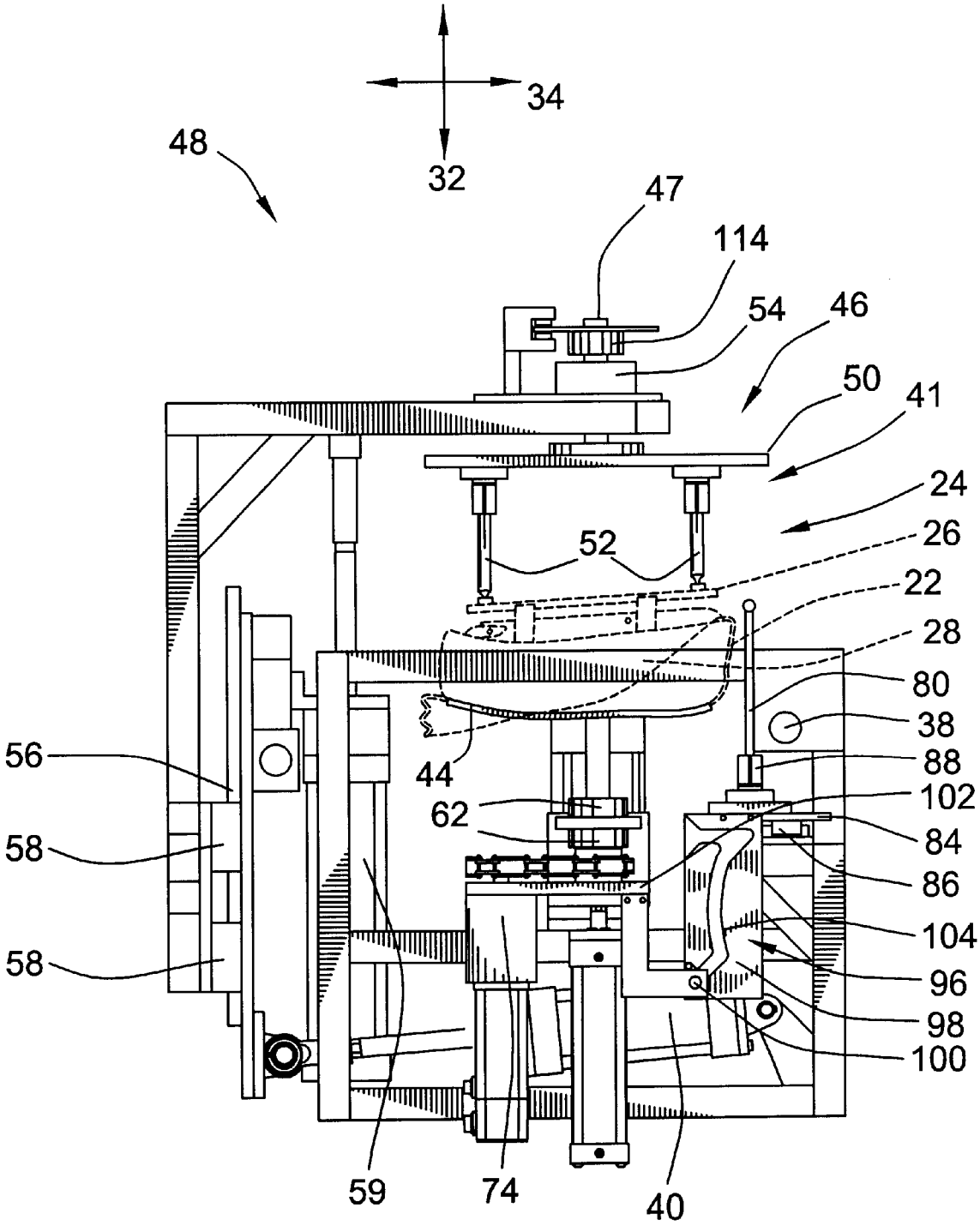
Figure 8:
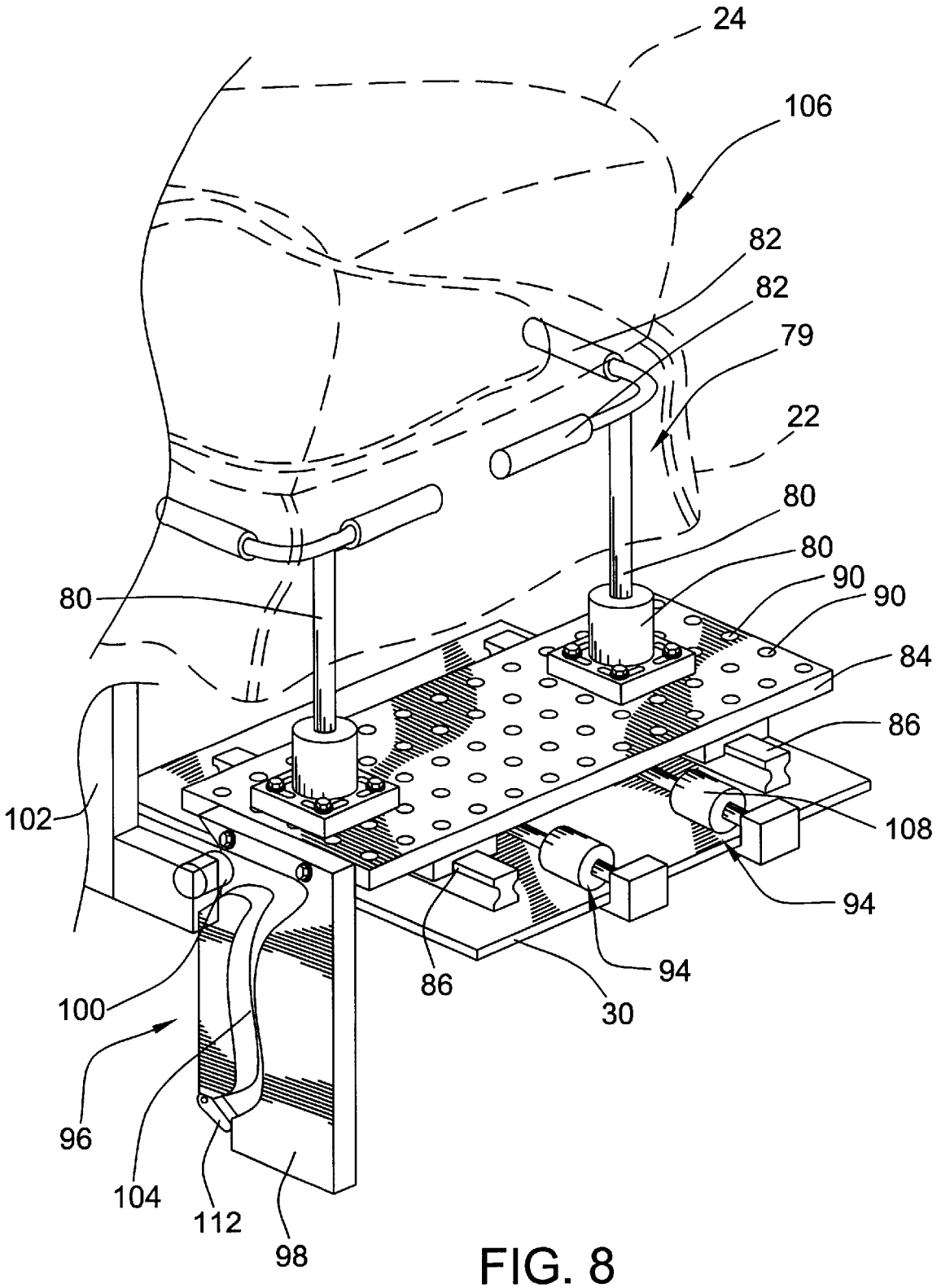
FIG. 8 is a perspective fragmentary illustration of the sliding mounting base and stanchion rods and cam mechanism according to an embodiment of the present invention

To accomplish the tilt feature, the support frame 30 can be pivotably mounted via hinge 38 on a base frame 36 which is supported on the shop floor by adjustable support posts. A pneumatic cylinder 40 or other actuator is operatively connected between the support frame 30 and the base frame 38 and is operable to selectively tilt the support frame 30 a slight degree as desired through retraction and expansion of the cylinder 40. It would also be appreciated that the tilt feature can be eliminated if cost is a concern in which the outer support frame and other tilt components would be eliminated. The remaining components would then be those generally shown in FIGS. 5–7.

The machine 20 includes a seat retainer generally indicated at 41 which in this embodiment takes the form of the combination of a bottom seat nest 42 and a top locating and engaging pin assembly 46 for holding the seat cushion 24 along the vertical axis 32. The top surface of the bottom seat nest 42 is contoured and matched closely to the contour of the bottom surface 45 of the seat cushion 24 to provide a receiving seat 44 on the nest 42 which generally aligns the seat cushion 24 at the desired angular position when placed thereon.

The engaging pin assembly 46 includes pins 52 projecting from a mounting plate 50. The pins 52 are received in locating holes (not shown) in the metal frame 26 of the seat cushion 24 such that the seat cushion is held between the engaging pin assembly 46 and the nest 42. The engaging pin assembly 46 is supported through a support shaft 47 rotatably mounted via bearing mounts 54 to an upper carriage 48 such that the engaging pin assembly 46 may be rotated relative to the upper carriage 48 but not linearly movable relative to the carriage 48. The upper carriage 48 includes a linear slide assembly comprising slides 58 slidably disposed on guide rods 56 such that the carriage 48 is adapted for vertical reciprocating sliding movement relative to the support frame 30 in the vertical axis 32. A pneumatic cylinder 59 or other actuator connected between the frame 30 and the carriage 48 raises and lowers the carriage 48 for facilitating seat compression operations and seat plunging operations as will be described in further detail later.

Figure 9:
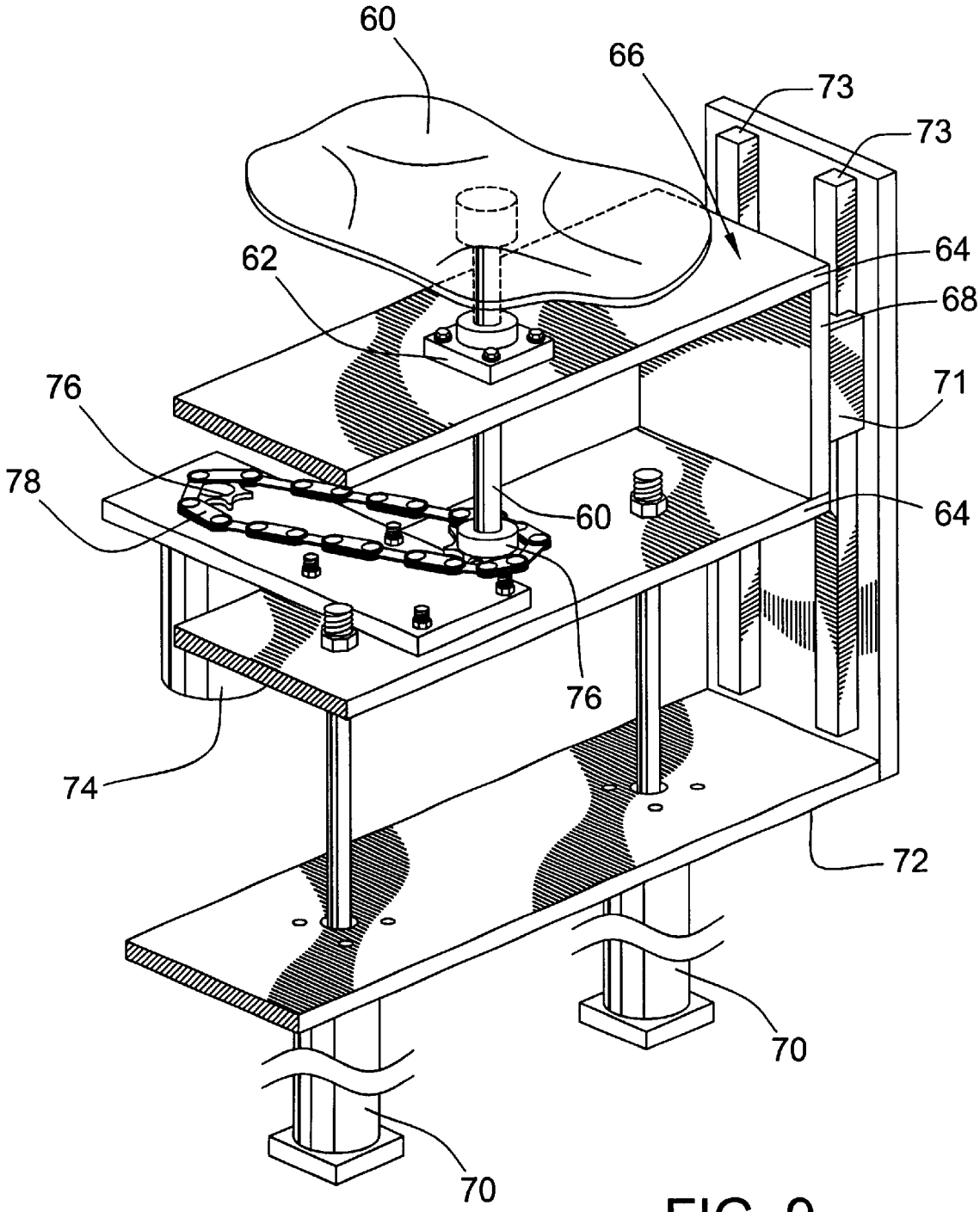
FIG. 9 is a perspective fragmentary illustration of the seat nest assembly.

The nest 42 is also mounted for sliding movement in the vertical axis 32. In particular, the nest 42 is supported by a rotatable shaft 60 that is mounted through upper and lower bearing mounts 62 to a movable box-like support structure 66 such that the nest 42 is rotatable but not linearly movable relative to the support structure 66. Referring to FIG. 9, the support structure 66 includes two spaced apart horizontal support members 64 and two vertical members 68. The support structure 66 is supported on the rods of a pair of pneumatic cylinders 70 that control the vertical position of the support structure 66 and therefore the seat nest 42 in the preferred embodiment. The support structure 66 is also carried on a linear bearings or other slide assembly comprising bearing guides 71 and rails 73. The cylinders 70 are securely mounted to the frame 30 through a mounting plate 72 and may be directly below the support structure 66. Alternatively, the cylinders 70 may be mounted at a different lateral position out of the movement path of the support structure 66 such that the cylinders 70 can be mounted higher on the frame 30 and connected to the support structure through a mechanical linkage. In the preferred embodiment, the cylinders 70 operate as actuators expanding and retracting through the pressurization and exhaustion of air pressure to raise and lower the support structure 66 and therefore determine the vertical position of the seat nest 42. The cylinders 70 assist in plunging operations and also provide resistance against the action of the upper carriage cylinder 59 during seat cushion compression operations. Alternatively, the cylinders 70 can be operated as air cushions or replaced with more conventional air cushions or springs that cushion the plunging operations. In this alternative, the air cushions would be designed to start to release at a predetermined magnitude corresponding to the desired compression in the seat cushion 24.

In this type of machine 20 and for bottom seat stuffing applications generally, it is typically desirable to first compress the seat cushion 24 before proceeding to rolling the seat cover 22 around the edges of the seat cushion 24. As such, the machine 20 first compresses the seat cushion 24 by lowering the upper carriage 48 via the upper carriage cylinder 59 while holding the vertical position of the seat nest 42 substantially stationary. Once the desired seat compression is achieved, the seat cushion 42 is plunged relative to a stanchion rod assembly generally indicated at 79 which is operable to roll the inside-out seat cover 22 inside out over the seat cushion 24. In the preferred embodiment, the plunging operation is achieved by operating the upper carriage cylinder 59 and the bottom support structure cylinders 70.

It is a feature of the stuffer machine 20 that seat retainer 41 and therefore the foam seat cushion 24 can be rotated to better facilitate fastening operations of the seat cover 22 to the seat cushion 24 during assembly. Rotation is accomplished through the provision of bearing mounts 54, 62, which allow rotation of the diametrically opposed support shafts 47, 60. It is a further feature that the rotary or angular position of the seat nest 42 is controlled and determined by a electrical servo actuator 74 connected to the support shaft 60 through a direct drive that includes sprockets 76 on the shaft ends of the support shaft 60 and the servo actuator 74 and an endless chain 78 entrained around the sprockets 76. Programmed controls along with worker input operate the servo actuator 74 to selectively position the seat nest 42 at desired angular positions to facilitate seat cover fastening operations. Because the seat cushion 24 is in compression when it is rotated the engaging pin assembly 46 and the seat nest 42 rotate in unison during assembly operations.

In accordance with the present invention, the preferred embodiment provides horizontally sliding stanchion rods 80. The rods 80 are mounted to a stanchion carriage or hat is slidably mounted to a support plate of the support frame 30 with linear bearings or other forms of linear slide 86. The linear slides 86 allow the base 84 and therefore the rods to be movable rearwardly and forwardly in the horizontal axis 34. The rods 80 are mounted to the base 84 with stands 88 such that the rods 80 are spaced apart a selected distance such that the are capable of closely receiving the seat cover 22 inside out. As is conventional in the art, the base 84 includes many different mounting holes 90 and the stands 88 include slots 92, both which receive fasteners, such that the position and spacing of the rods 80 are adjustable to meet changes in seat specifications. The stanchion rods 80 preferably include rollers 82 at their free ends such that the rods more easily roll the inside out seat cover 22 onto the seat cushion 24.

In further accordance with the present invention, the horizontal position of the mounting base 84 and therefore the horizontal position of the stanchion rods 80 are controlled or otherwise determined based on the vertical position of the seat cushion 24 and/or seat retainer 41 such that the stanchion rods 80 more closely follow the contour of seat cushions to achieve an easier or better fit of the seat cover. In the illustrated stuffer machine 20, two cooperating mechanisms are used to control the horizontal position of the mounting base 84 and therefore the stanchion rods 80, including a spring mechanism 94 and a cam mechanism 96. The cam mechanism 96, includes a cam track 98 secured to the mounting base 84 and a follower 100 secured to the movable support structure 66 via extension arm 102. During downward plunging movement of the support structure 66 and therefore the seat cushion 24, the follower 100 substantially follows the eccentric surface 104 on the cam track 98 such that the base is directed horizontally forwardly and rearwardly in the horizontal axis 34. In particular, the follower 100 engages the cam track 98 to move the cam track 98 along with the stanchion base 84 forwardly and rearwardly. The eccentric surface 104 is configured to be closely matched to the countered side surface 106 of the seat cushion 24 such that the rollers 82 of the stanchion rods 80 are adapted to closely follow the countered side surface 106. The spring mechanism 94 comprises a pressurized air cushion 108 or alternatively a coil spring which in this embodiment biases the stanchion base 84 horizontally forward and keeps the follower in substantial contact with the eccentric surface 104.

In an alternative embodiment, either the cam mechanism 96 or the spring mechanism 94 can be eliminated. For example, a continuous cam track would allow the spring mechanism to be eliminated. Similarly, the air cushion 108 or other spring mechanism can bias the stanchion base 84 and rods 80 to a home position, thereby eliminating the cam mechanism. With this type of arrangement, the outer contour surface 106 of the seat cushions directly determines the positions of the stanchion rods 80 as the engagement of the rollers 82 against the seat causes the seat to work against the air cushion 108. For example, in one arrangement, outward projections in the contour surface 106 can push the rods and the mounting base in one horizontal direction against the action of the air cushion 108 and the air cushion can return the mounting base and the rods into recess in the contour surface 106. A further embodiment (not shown) is for motorized programmed actuation of the stanchion base, based on sensory input indicating the vertical relative positions between the stanchion rods and the seat retainer. For example, a pneumatic cylinder or electrical motor with either a slip clutch or a rotary tensioned could also be used to effect closer following of the stanchion rods along the seat contour during vertical plunging operations. However, these further alternatives are less preferred due to the added expense of programming and need for additional typically expensive components. Moreover, such motorization may slow down assembly operations which would be undesirable.

With an understanding of the structure of the bottom seat stuffer machine 20, operation of the machine 20 will be now described in further detail. First the machine is set up. Adjustable vertical support legs 110 on the base frame 36 can be expanded or retracted to raise or lower the machine 20 to the desired height suitable for the worker, as is well known in the art. Next, the worker can tilt the support frame 30 as desired via operation of tilt cylinder 40 to locate the seat retainer 41 more closely and at a more accessible location. Because this machine 20 is intended to use partially assembled seats that include metal frames 26 which are heavy and increase the arduous nature of the task performed by the worker, the tilt feature is a highly desirable feature.

Once the machine 20 is set up, it should be noted that the engaging pin assembly 46 and the seat nest 42 are in spaced apart relationship sufficient to allow the worker to place seat components therebetween, as shown in FIG. 1. Accordingly, a worker then places an inside out seat cover 22 over the stanchion rods 80 which have been selectively spaced apart, and also generally across the top of the seat nest 42. If the machine is being used for a new and different configuration of seat, the spacing of the stanchion rods 80 can be adjusted by loosening the fasteners and remounting the rods to the stanchion mounting base 84. Next, the worker arranges a foam seat cushion 24 (including foam pad 28 and metal frame 26) on the seat nest 42. The shape of the seat nest 42 is contoured to the bottom surface of the seat cushion such that the locating holes in the metal frame 26 are generally aligned to receive the engaging pins of the engaging pin assembly 46. Once the seat components are in position, the worker lowers the upper carriage 48 by operating the associated pneumatic cylinder 59 such that the engaging pin assembly 46 is received into locating holes in the metal frame 26. The worker operates the cylinder further 59 to effect a two stage operation, first to compress the seat cushion 24 and then to plunge the seat cushion 24 through the stanchion rods 80. After the seat cushion 24 is in a sufficient compression state, the lower cylinders 70 which have been supporting the seat nest 42 allow the entire seat retainer 41 and seat cushion 24 and cover 22 to drop down. The lower cylinders 70 may assist in the downward plunging movement. In any event, the rollers 82 of the stanchion rods 80 engage the outer contoured surface of the seat cushion 24 through the cover 22, to roll the cover 22 outside out over the seat cushion 24.

It is important to note that during this plunging movement, the position of the stanchion rods 80 is a function of the vertical position of the seat cushion 24 and retainer 41. In particular, the follower 100 engages the eccentric 104 (whose surface is closely matched to the contour of seat cushion) of the cam track 98 under the action of the spring mechanism 94 to move the stanchion base 84 horizontally forward and rearward. The horizontal movement of the stanchion rods 80 accomplishes several advantages. One advantage is that the a better fit of the cover 22 is achieved on the seat cushion 24, which reduces further subsequent manipulation by the worker to achieve the desired fit. Another advantage is that a more consistent pressure is applied by the stanchion rods thereby preventing rips or damage to the seat cover 22. Towards the end of the plunging action, the follower 100 exits through a one-way spring loaded pivoting door 112 and then returns along the outside of the cam track 98 as the seat retainer 41 is raised, and then back to its home position for another run on the cam track.

At the end of the plunging action, the seat cover 22 is substantially installed on the seat cushion 24, however, the cover 22 now must be fastened or otherwise secured to the seat cushion to ensure it does not come off and to keep a tight fit. Accordingly, the seat retainer 41 is raised with the seat cushion 24 still in compression. Then, the worker manually begins securing operations of the seat cover 22, operating the servo actuator 74 to obtain access to securing or fastening latches on the rear side of the seat cover and cushion. A disc brake 114 is also used to hold the seat cushion and cover in position during securing operations as well as during seat compression and seat plunging operations. Once the cover 22 is secured to the seat cushion 24, the upper carriage 48 is raised to relieve the compression in the seat and allow the worker to remove the finished bottom seat and start the new process with a new cover and cushion.

While the preferred embodiment has been depicted above with certain alternatives listed above, it will be readily appreciated by those skilled in the art that the present invention is not necessarily limited to bottom seat stuffers, and that horizontally sliding stanchion rods mounted on slides can be applied to other machines in which the seat contour poses certain difficulties. Certain claims appended hereto are meant to include these other possibilities listed below. The invention can be incorporated in a "skinner" or backrest stuffer, such as those shown in U.S. Pat. Nos. 4,385,427 and 5,774,965, the disclosures of which are hereby. incorporated by reference. In modern machines of these types, typically the seat retainer holds the end of the seat frame only of the seat cushion in a cantilever manner (and there is no seat cushion compression stage). In these machines, the stanchion rods would be mounted on slides, preferrably with the front stanchion rods that engage the seat front being movable independent of the back stanchions rods. The invention may also be used in a neck rest stuffing machine. Yet another possibility is that a bottom actuator vertically moves the stanchion base and rods rather than plunging the seat retainer as shown for example in Bentseneider, U.S. Pat. No. 5,398,393 to achieve relative movement between the stanchion rod assembly and seat retainer. A further possibility is that the machine is mounted for horizontal plunging movement rather than vertical, as shown in U.S. Pat. No. 5,774,965. In any event, the present invention is characterized by the fact that the stanchion rods move in a plane perpendicular to the plunging motion (whether it is horizontal or vertical) to more closely follow the contour of the seat surface and achieve an easier and/or better fit. The patents identified herein are hereby incorporated by reference in their entireties to the extent necessary to provide understanding of further alternative embodiments.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A seat assembly machine for assembling flexible covers on foam seat cushions, the seat cushion having a contoured surface, comprising:

a frame having first and second axes generally perpendicular with each other;

a seat cushion retainer carried by the frame adapted to retain a foam seat along the first axis;

a group of stanchion rods selectively spaced apart a distance to receive flexible covers inside out, the stanchion rods being slidably carried relative to the frame and slidable in the second axis;

an actuator carried by the frame operatively connected to the stanchion rods or the seat cushion retainer, operative between expanded and contracted positions to facilitate relative reciprocating movement between the stanchion rods and the seat cushion retainer along the first axis; and a cam mechanism including a track having an eccentric surface matched closely to the contoured surface of an intended seat cushion and a follower adapted to follow along the eccentric surface, the stanchion rods being operatively connected to the cam mechanism and substantially following the eccentric surface such that the position of the stanchion rods in the second axis is determined by the relative positions of the seat retainer and stanchion rods along the first axis.

2. The seat assembly machine of claim 1 further comprising a stanchion rod base supporting the stanchion rods; and a spring mechanism biasing the stanchion rod base toward a home position.

3. The seat assembly machine of claim 1 wherein the cam track is secured to the stanchion rod base and the follower is secured to the seat cushion retainer.

4. The seat assembly machine of claim 1 wherein the seat cushion retainer comprises:

a bottom seat nest adapted to receive the bottom seat side of the seat cushion, the bottom nest being supported by air cylinders;

a carriage movable relative to the frame including an engaging assembly adapted to engage the top side of the seat cushion, the carriage being directly connected to the actuator removement thereby; and wherein a seat cushion is adapted to be subjected to a first compression stage and a subsequent compression stage, during the first stage the carriage being moved closer to the bottom seat nest for compressing the seat cushion, during the second stage the combination of the carriage and the bottom seat nest being plunged through the stanchion rods to install the seat cover on the cushion.

5. The seat assembly machine of claim 4 wherein the engaging assembly and seat nest are mounted for rotation, further comprising:

a servo actuator drivingly connected to the seat nest via a direct drive for controlling a rotary position of the seat cushion retainer; and a brake operatively connected to the engaging assembly adapted to hold the rotary position of the seat cushion retainer.

6. The seat cushion assembly machine of claim 5 wherein the engaging assembly includes pins adapted having ends adapted to engage a seat frame mounted to the seat cushion.

7. The seat assembly machine of claim 1 further comprising:

a fixed support frame, a first frame being pivotably mounted to the fixed support frame via a hinge such that the seat nest can be tilted to an ergonomic location; and means for controllably tilting the first frame relative to the fixed support frame.

8. The seat assembly machine of claim 1 wherein when the seat assembly machine is assembling flexible covers on foam seat cushions, the eccentric controls the position of the follower and the stanchion rods while the stanchion rods are installing the cover outside out over the foam seat cushion.

9. The seat assembly machine of claim 8 wherein the follower engages the cam mechanism until the seat cover is substantially completely installed on the foam seat cushion.

10. The seat assembly machine of claim 1 wherein the cam mechanism drives the stanchion rods both inwardly and outwardly relative to the seat cushion and over the removable contoured surface of the seat cushion while the stanchion rods are installing the cover outside out over the foam seat cushion.

11. The seat assembly machine of claim 2 wherein the stanchion rods are movably secured to the stanchion rod base in a fixed spaced apart relation, further comprising means for adjusting the fixed spacing of the stanchion rods on the stanchion rod base.

12. A seat assembly machine for assembling flexible covers on foam seat cushions, the seat cushion having a contoured surface, comprising:

a frame having first and second axes generally perpendicular with each other;

a seat cushion retainer carried by the frame adapted to retain a foam seat along the frist axis;

at least one stanchion rod adapted to receive a flexible cover inside out;

a movable stanchion rod base supporting the at least one stanchion rod;

a linear slide assembly fixed to the frame and carrying the stanchion rod base such that the stanchion rod base is slidable relatively to the frame in the second axis;

an actuator carried by the frame operatively connected to the at least one stanchion rod or the seat cushion retainer, operative between expanded and contracted positions to facilitate relative reciprocating movement between the at least one stanchion rod and the seat cushion retainer along the first axis; and a cam mechanism including a track having an eccentric surface matched closely to the contoured surface of an intended seat cushion and a follower adapted to follow along the ecentric surface, the stanchion rod base being operatively connected to the cam mechanism and substantially following the ecentric surface such that the position of the stanchion rods in the second axis is determined by the relative positions of the seat retainer and stanchion rods along the first axis.

13. The seat assembly machine of claim 12, wherein the linear slide assembly includes a pair of linear bearings.

14. The seat assembly machine of claim 12 further comprising a spring mechanism biasing the stanchion rod base toward a predetermined position.

15. The seat assembly machine of claim 12 wherein the seat cushion retainer comprises:

a bottom seat nest adapted to receive the bottom seat side of the seat cushion, the bottom nest being supported by air cylinders;

a carriage movable relative to the frame including an engaging assembly adapted to engage the top side of the seat cushion, the carriage being directly connected to the actuator for movement thereby; and wherein a seat cushion is adapted to be subjected to a first compression stage and a subsequent compression stage, during the first stage the carriage being moved closer to the bottom seat nest for compressing the seat cushion, during the second stage the combination of the carriage and the bottom seat nest being plunged through the at least one stanchion rod to install the seat cover on the cushion.

16. The seat assembly machine of claim 15 wherein the engaging assembly and seat nest are mounted for rotation, further comprising:

a servo actuator drivingly connected to the seat nest via a direct drive for controlling a rotary position of the seat retainer; and a brake operatively connected to the engaging assembly adapted to hold the rotary position of the seat retainer.

17. The seat assembly machine of claim 12 further comprising:

a fixed support frame, a first frame being pivotably mounted to the fixed support frame via a hinge such that the seat nest can be tilted to an ergonomic location; and means for controllably tilting the first frame relative to the fixed support frame.

18. The seat assembly machine of claim 12 wherein when the seat assembly machine is assembling flexible covers on foam seat cushions, the eccentric surface controls the position of the follower and the at least one stanchion rod while the at least one stanchion rods is installing the cover outside out over the foam seat cushion.

19. The seat assembly machine of claim 18 wherein the follower engages the cam mechanism until the seat cover is substantially completely installed on the foam seat cushion.

20. The seat assembly machine of claim 12 wherein the cam mechanism drives the at least one stanchion rod both inwardly and outwardly relative to the seat cushion and over the contoured surface of the seat cushion while the at least one stanchion rod is installing the cover outside out over the foam seat cushion.

21. The seat assembly machine of claim 12 wherein the at least one stanchion rod comprises and plurality of stanchion rods and wherein the stanchion rods are removably secured to the stanchion rod base in a fixed spaced apart relation, further comprising means for adjusting the fixed spacing of the stanchion rods on the stanchion rod base.

* * * * *

UNITED STATES PATENT AND TRADEMARK OFFICE

CERTIFICATE OF CORRECTION

PATENT NO. : 6,434,806 B1 
DATED : August 20, 2002
INVENTOR(S) : Michael Allen Walt, II It is certified that error appears in the above-identified patent and that said Letters Patent is hereby corrected as shown below:

Column 8,
Line 24, change “removement” to -- for movement --.
Lines 62-63, after “over the” and before “contoured surface”, delete “removable”.
Line 67, change “movably” to -- removably --.

Column 9,
Line 10, change “frist” to -- first --.
Line 18, change “relatively” to -- relative --.
Lines 28 and 30, change “ecentric” to -- eccentric --.

Signed and Sealed this

Twenty-sixth Day of November, 2002

*Attest:*

*Attesting Officer*

JAMES E. ROGAN
*Director of the United States Patent and Trademark Office*